US010459408B2

(12) United States Patent
Hasegawa et al.

(10) Patent No.: US 10,459,408 B2
(45) Date of Patent: Oct. 29, 2019

(54) ELECTRONIC TIMEPIECE, DISPLAY CONTROL METHOD AND STORAGE MEDIUM

(71) Applicant: CASIO COMPUTER CO., LTD., Tokyo (JP)

(72) Inventors: Kosuke Hasegawa, Koganei (JP); Yohei Kawaguchi, Akishima (JP); Katsuhiko Obata, Fussa (JP); Mitsuaki Matsuo, Fussa (JP); Shimpei Matsuda, Kunitachi (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 80 days.

(21) Appl. No.: 15/885,238

(22) Filed: Jan. 31, 2018

(65) Prior Publication Data

US 2018/0246472 A1 Aug. 30, 2018

(30) Foreign Application Priority Data

Feb. 27, 2017 (JP) ..... 2017-034397

(51) Int. Cl.
*G04G 21/04* (2013.01)
*G04R 20/26* (2013.01)
(Continued)

(52) U.S. Cl.
CPC ..... *G04G 21/04* (2013.01); *G04C 10/00* (2013.01); *G04G 9/0064* (2013.01); *G04R 20/04* (2013.01); *G04R 20/26* (2013.01); *G04R 60/06* (2013.01)

(58) Field of Classification Search
CPC ..... G04G 21/04; G04G 9/0064; G04C 10/00; G04R 20/04; G04R 20/26; G04R 60/06
(Continued)

(56) References Cited

U.S. PATENT DOCUMENTS 6,310,833 B1 * 10/2001 Guyett ..... G04G 13/02 368/63
7,974,155 B2 * 7/2011 Matsuzaki ..... G04R 20/04 342/357.69
(Continued)

FOREIGN PATENT DOCUMENTS

JP 2012-207939 A 10/2012
JP 2013-181915 A 9/2013
JP 2015-135347 A 7/2015

*Primary Examiner* — Edwin A. Leon
(74) *Attorney, Agent, or Firm* — Fitch, Even, Tabin & Flannery LLP

(57) ABSTRACT

An electronic timepiece, including: a counter; a display section; a first processor; a second processor; and a power supply section which supplies electric power to each section from a battery, wherein when an output voltage from the power supply section decreases to less than a predetermined first reference voltage, the first processor stops a display operation by the display section, when the time information is acquired by the processing operation of the second processor, the first processor corrects the time counted by the counter based on the acquired time information and causes the display section to display the corrected time, and when the output voltage decreases to less than the first reference voltage following an acquisition operation of the time information by the second processor, the first processor does not stop a time display operation during a predetermined pending period.

20 Claims, 3 Drawing Sheets

(51) Int. Cl.

| | |
|---|---|
| ***G04G 9/00*** | (2006.01) |
| ***G04R 20/04*** | (2013.01) |
| ***G04C 10/00*** | (2006.01) |
| *G04R 60/06* | (2013.01) |

(58) Field of Classification Search
USPC ..... 368/228
See application file for complete search history.

(56) References Cited

U.S. PATENT DOCUMENTS

| | | | | |
|---|---|---|---|---|
| 9,635,513 | B2 * | 4/2017 | Oshita | H04W 4/029 |
| 2004/0225439 | A1 * | 11/2004 | Gronemeyer | G01R 19/16542 701/469 |

* cited by examiner

| VOLTAGE (CONDITION) | LEVEL | WARNING | RESTRICTION |
|---|---|---|---|
| VH≦V | High | --- | --- |
| VM≦V<VH | Mid | --- | --- |
| VL≦V<VM | Low | WARNED (2 SECONDS HAND MOVEMENT) | SATELLITE RADIO WAVE RECEPTION PROCESSING SECTION, NOTIFICATION OPERATION |
| V<VL (60 MINUTES FROM RECEPTION) | | | |
| V<VL | Charge | STOP DISPLAY (PREDETERMINED POSITION) | ALL FUNCTIONAL OPERATIONS |

ELECTRONIC TIMEPIECE, DISPLAY CONTROL METHOD AND STORAGE MEDIUM

CROSS-REFERENCE TO RELATED APPLICATION

This application is based upon and claims the benefit of priority from the prior Japanese Patent Application No. 2017-034397, filed on Feb. 27, 2017, the entire contents of which are incorporated herein by reference.

BACKGROUND OF THE INVENTION

1. Field of the Invention

The present invention relates to an electronic timepiece, a display control method and a storage medium.

2. Description of Related Art

There has been conventionally an electronic timepiece which can correct a counted date and time or a local time corresponding to a current position by receiving radio waves from positioning satellites to acquire date and time information or perform positioning and which can display the current position or the time zone. Even if the user does not perform an operation of correcting the date and time or the time zone, an accurate date and time can be easily displayed in various areas of the world.

The radio wave reception operation for acquiring date and time information, especially, the operation of receiving radio waves from the positioning satellites is a very high load compared with normal operations for counting and displaying the date and time. Accordingly, when an electronic timepiece, especially, a compact type such as a portable type with a battery having a small capacity is used, a large decrease in voltage temporarily occurs due to the reception operation, and the decrease in voltage influences other operations in some cases.

As for this matter, for example, Japanese Patent Application Laid Open Publication No. 2012-207939 which is a Japanese patent document discloses a technique of displaying a warning indicating the decrease in battery level during a period of the length corresponding to the decreased voltage value, the duration of the radio wave reception operation or the like when the radio wave reception operation is finished, and discloses a technique of displaying a warning of a content which is different from a content of a warning that is displayed in a case of normal decrease in battery level.

There is also known a technique of moving a hand to an initial position and stopping the display operation to prevent deep discharge when an electronic timepiece using hands does not have a sufficient remaining amount of a battery and the voltage decreases.

However, when a high-load operation for acquiring time information is performed, there are some cases where the voltage decreases by a single operation to a level which possibly causes a problem in normal operations especially in an electronic timepiece having a small capacity of a battery. In such a case, when the time display is stopped each time the voltage decreases, the time display is restricted even when time information is acquired, and thus convenience of the user is ruined. On the other hand, when execution of the high-load operation is allowed only in a case of having a battery remaining amount not generating any problem in the time display operation, the situation allowing the execution of this operation is remarkably limited. Thus, practical problems occur in acquiring accurate time information and surely performing the display.

SUMMARY OF THE INVENTION

There are disclosed an electronic timepiece, a display control method and a storage medium.

According to a preferred embodiment of the present invention, there is provided an electronic timepiece, including: a counter which counts a time; a display section which performs time display based on the counted time; a first processor; a second processor which performs a predetermined processing operation of acquiring time information; and a power supply section which supplies electric power to each section from a battery, wherein when an output voltage from the power supply section decreases to less than a predetermined first reference voltage, the first processor stops a display operation by the display section, when the time information is acquired by the processing operation of the second processor, the first processor corrects the time counted by the counter based on the acquired time information and causes the display section to display the corrected time, and when the output voltage decreases to less than the first reference voltage following an acquisition operation of the time information by the second processor, the first processor does not stop a time display operation during a predetermined pending period.

BRIEF DESCRIPTION OF THE DRAWINGS

The above and other objects, advantages and features of the present invention will become more fully understood from the detailed description given hereinafter and the appended drawings which are given byway of illustration only, and thus are not intended as a definition of the limits of the present invention, and wherein.

DETAILED DESCRIPTION OF THE PREFERRED EMBODIMENT

Hereinafter, an embodiment will be described with reference to the drawings.

Figures 1, 2:
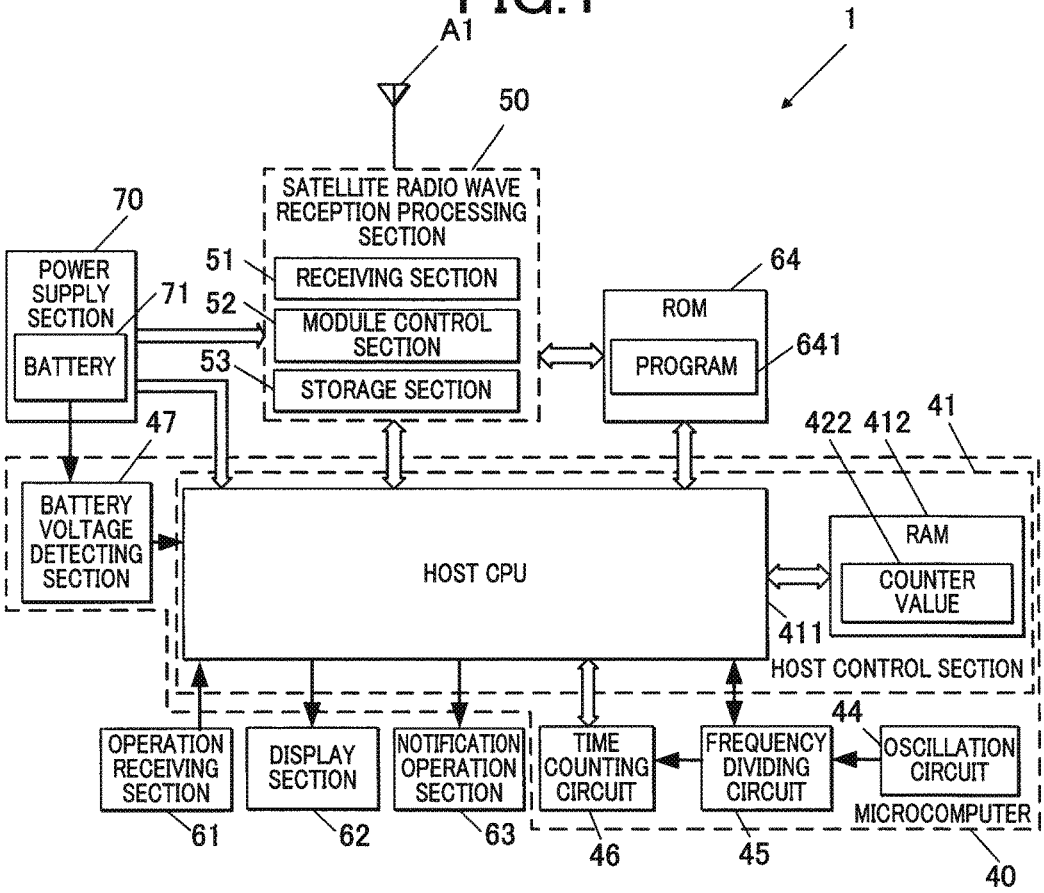
FIG. 1 is a block diagram showing a functional configuration of an embodiment of an electronic timepiece of the present invention.
FIG. 2 is a diagram showing a reference voltage table.

FIG. 1 is a block diagram showing a functional configuration of an electronic timepiece 1 in the embodiment.

This electronic timepiece 1 includes a microcomputer 40, a satellite radio wave reception processing section 50 (second processor, and satellite radio wave receiving section), an antenna A1, an operation receiving section 61, a display section 62, a notification operation section 63, a ROM 64, a power supply section 70 and such like.

The microcomputer 40 performs control of various operations of the electronic timepiece 1. The microcomputer 40 includes a host control section 41 (first processor), an oscillation circuit 44, a frequency dividing circuit 45, a time counting circuit 46 (counter), a battery voltage detecting section 47 (voltage detecting section) and such like.

The host control section 41 includes a host CPU 411, a RAM 412 and such like, performs various types of arithmetic processing, stores data and integrally controls the operations of the electronic timepiece 1 by the microcomputer 40. The host CPU 411 is a processor which performs arithmetic processing. The RAM 412 is a volatile memory which stores temporal data. The RAM 412 may include a non-volatile memory which is rewritable and updatable. The RAM 412 stores data of a counter value 422.

The battery voltage detecting section 47 detects an output voltage from a battery 71 of the power supply section 70, and outputs a detection result to the host CPU 411. The battery voltage detecting section 47, here, outputs a measured value of a voltage value as a value of a predetermined number of steps (for example, 8 to 16 steps) corresponding to the output bit number. Or, the battery voltage detecting section 47 may include a comparator or the like, and output a magnitude relationship (determination result) with respect to a predetermined reference value (for example, aftermentioned first reference voltage VL). In such a way, the battery voltage detecting section 47 can output information in an arbitrary format and an arbitrary size within a range enabling to obtain information which is necessary for aftermentioned determination of output voltage level and determination of operation restriction (especially, whether to stop time display) by the host control section 41 (host CPU 411).

The oscillation circuit 44 generates a predetermined frequency signal and outputs the frequency signal to the frequency dividing circuit 45. The oscillation circuit 44 includes a crystal oscillator, for example, and generates a signal of a predetermined frequency which is approximately 16 kHz, 32 kHz or the like. The crystal oscillator may be externally provided to the microcomputer 40.

The frequency dividing circuit 45 divides a predetermined frequency signal which was input from the oscillation circuit 44 to convert them into frequency signals which are used by the host CPU 411 and the time counting circuit 46, and outputs the converted signals to the host CPU 411, the time counting circuit 46 and such like.

The time counting circuit 46 counts the current date and time (a time) by counting the signals which are input from the frequency dividing circuit 45. The date and time counted by the time counting circuit 46 has an error which is, for example, approximately ±0.5 seconds per day. The date and time counted by the time counting circuit 46 can be corrected in accordance with an instruction from the host CPU 411.

The satellite radio wave reception processing section 50 includes a receiving section 51, a module control section 52, a storage section 53 and such like, and performs a predetermined processing operation for acquiring date and time information (time information) and positional information. The receiving section 51 tracks and receives radio waves from the positioning satellites, and demodulates a navigation message. The module control section 52 acquires date and time information, positional information of each positioning satellite and such like on the basis of the navigation message obtained from the radio waves from the positioning satellites which are tracked by the receiving section 51. The module control section 52 includes a CPU, a RAM and such like, and performs positioning of calculating the current position of the electronic timepiece itself by using the acquired date and time information and the positional information of each positioning satellite. The storage section 53 stores various types of setting data for the receiving operation and the control program for the operation of the module control section 52.

The electric power (consumed electric current, load) required for the operation of positioning by the satellite radio wave reception processing section 50 and power consumption per operation until the end of the positioning operation are remarkably large compared with the other operations in the electronic timepiece 1 such as date and time counting operation and display operation by the display section 62.

The ROM 64 stores setting data and a program 641 for various operations of the electronic timepiece 1. The program 641 includes an operation control program of performing a notification operation and operation restriction based on a voltage value by the battery voltage detecting section 47. The setting data includes table data or the like of voltage values which are set as references in this operation control program. The ROM 64 includes a mask ROM or the like which is not rewritable and updatable, a non-volatile memory such as a flash memory or the like which is updatable, or both of them.

The operation receiving section 61 receives an input operation from outside and outputs the input operation as an input signal to the host CPU 411. The operation receiving section 61 has, for example, a push button switch as a configuration of receiving an input operation from outside. The operation receiving section 61 may have a crown, a touch panel or the like.

The display section 62 displays various types of information according to control of the host CPU 411. The display section 62 can display at least the current time on the basis of the date and time counted by the time counting circuit 46. The display section 62 may include a plurality of hands (hour hand, minute hand, second hand and such like), for example, or may include a configuration of allowing digital display by a liquid crystal screen.

The notification operation section 63 performs a predetermined notification operation on the basis of control of the host CPU 411. The notification operation section 63 is, for example, a beep sound generating section which generates beep sound, an illuminating section which performs an illumination operation, a combination thereof and such like.

The power supply section 70 supplies an electric power from the battery 71 to the sections such as the microcomputer 40 and the radio wave reception processing section 50. The battery 71 may have a power generating section included in the electronic timepiece 1 and a secondary cell which is charged by electromotive force of the power generating section, or may be a button type cell which can be attached to and detached from the electronic timepiece 1 by the user. The power generating section is a solar generating section, for example. Here, it is desirable that a battery 71 which is light and compact is used for making the electronic timepiece 1 be light and compact.

Next, the operation control corresponding to the detected voltage in the electronic timepiece 1 in the embodiment will be described.

Though the output voltage from the power supply section 70 can be maintained for a long time while slightly exceeding the operation voltages of the respective sections, the output voltage gradually decreases following the reduction of the remaining amount of the battery 71. In a case of performing an operation which is high load compared with the capacity of the battery 71, the output voltage decreases temporarily. When the output voltage decreases, it is not possible to maintain the operation of the satellite radio wave reception processing section 50 and the operation of the display section 62, and when the output voltage further decreases, the operations of the host CPU 411 and the RAM 412 themselves are not possible. In such a case, in order to prevent data loss and damage of the power supply section 70 due to the deep discharge especially, a predetermined notification operation is performed by the display section 62 and/or a notification operation section 63 so as to warn the user, and further, each operation is stopped at a reference voltage before the operation of each section becomes difficult to perform.

FIG. 2 is a diagram showing a reference voltage table in the electronic timepiece 1 in the embodiment.

Here, a first reference voltage VL, a second reference voltage VM which is higher than the first reference voltage VL and a third reference voltage VH which is higher than the second reference voltage VM are set as reference voltages. The first reference voltage VL is a voltage which is a reference for stopping the display operation of the date and time and such like. That is, the first reference voltage VL is the lower limit voltage of the display operation. In a Charge level in which the output voltage is lower than the first reference voltage, shortly after the output voltage V becomes smaller than the first reference voltage VL, all of the operation of the microcomputer 40, the display operation, the notification operation and the operation of the satellite radio wave reception processing section 50 become difficult. Thus, the display operation and the operation of the microcomputer 40 are stopped before that.

The output voltage V changes according to the environmental change of the surroundings, for example the surrounding temperature. In the electronic timepiece 1, the first reference voltage VL is set to be a little high with flexibility in order to prevent a situation that the output voltage V rapidly decreases temporarily from the first reference voltage VL following a large environmental change and the operation of the microcomputer 40 is interrupted unexpectedly. Accordingly, in the electronic timepiece 1, after the output voltage V decreases to the first reference voltage VL to come into the Charge level in a normal use state, it is possible to continue the minimum operation of the microcomputer 40 and the time counting and display operation for a little period, for example, for at least several hours, normally from several hours to several days.

Only the minimum operations of the time display, date and time counting and control processing of the microcomputer 40 necessary for maintaining these operations can be performed for a while, for example, from several days to several tens of days, after the output voltage from the power supply section 70 becomes lower than the second reference voltage VM to come into the Low level. However, when the reception operation by the satellite radio wave reception processing section 50 is performed in the Low level of the output voltage, the output voltage decreases before the reception operation is finished, and the time counting operation, normal operation of the microcomputer 40 and such like become difficult in some cases. The operation which is slightly a high load compared with the displaying and counting of the date and time such as the operation of the notification operation section 63 which performs an alarm notification operation and such like also possibly leads to large shortening of the period of the Low level.

The various functional operations of the electronic timepiece 1 such as the operation of the notification operation section 63, that is, the operations which are a high load compared to the display operation, time counting operation, normal operation of the microcomputer 40 and such lie can be performed stably in a Mid level which is equal to or higher than the second reference voltage VM slightly higher than the first reference voltage VL. In a battery 71 which has been conventionally widely used that is, in a secondary battery or a dry cell, due to the characteristics, the decrease speed of the output voltage V with respect to the increase in the total power consumption amount from the state of full charge or from the start of use is low in this Mid level, that is, the output voltage V of the battery 71 in a case of continuous use (or without charge in a case of a rechargeable battery) is in this Mid level during the most period.

However, in the electronic timepiece 1 in the embodiment, when the radio wave reception operation from the positioning satellite by the satellite radio wave reception processing section 50 is performed, even when the output voltage V is in the Mid level, depending on the remaining amount of the battery 71 at the start of the operation, the output voltage V at the end of the operation possibly decreases below the first reference voltage VL slightly temporarily within a range of surely maintaining the operation of the microcomputer 40.

The High level in which the output voltage V which is equal to or higher than the third reference voltage VH that is higher than the second reference voltage VM is detected is a state in which the battery 71 is nearly completely charged or a state immediately after the start of using the dry cell. In this case, in the electronic timepiece 1, the operations for the functions including positioning operation by the satellite radio wave reception processing section 50 can be executed without decrease in the output voltage V into the level presenting problems (that is, Charge level).

In the electronic timepiece 1 in the embodiment, the detection result of the output voltage V is acquired from the battery voltage detecting section 47 at predetermined time intervals (for example, 1 minute interval) to monitor which of the four levels of the voltage level is the output voltage V, and the restriction of operation corresponding to the voltage level is performed if necessary. In the embodiment, in a case where the output voltage V is the High level or the Mid level, the operation restriction of the electronic timepiece 1 is not performed.

On the other hand, in a case of the Low level, there is performed restriction not to start the operations such as operations of the satellite radio wave reception processing section 50 and the notification operation section 63, which are other than the basic operation of the microcomputer 40 for the counting and display of the date and time. In the Low level (less than the second reference voltage VM), there is performed a predetermined display operation (second notification operation) of warning that the device will run out of battery soon by notifying that the output value V of the battery 71 is in the Low level with the display section 62. For example, in a case where the display section 62 performs time display using an hour hand, a minute hand and a second hand, the user is warned by setting a hand movement of the second hand every two seconds. At this time, in a case where the display section 62 can separately display a date and a day of week, these display operations may be stopped. Thus, the minimum display operation of the hour and minute by the hour hand and the minute hand is continued, and the user can be aware of the hour and minute.

In a case where the output voltage V is in the Charge level (less than the first reference voltage VL), all the operations including the display operation of date and time are stopped in the electronic timepiece 1. After stopping the operations of the respective sections in the electronic timepiece 1, the microcomputer 40 performs predetermined shutdown processing to stop the microcomputer 40 itself. A lower limit reference voltage VC (less than the first reference voltage VL) of maintaining only the operation of the microcomputer 40 may be further determined in the Charge level. In this case, the shutdown processing of the microcomputer 40 is performed after the output voltage V becomes less than the lower limit reference voltage VC. In a case where an RTC (Real Time Clock) is provided separately from the microcomputer 40 and the RTC operates with a minute power which is supplied from another battery, the operation of the RTC is maintained independently. In this case, when the microcomputer 40 is restarted after shutdown, the host CPU 411 acquires date and time information from the RTC and restarts counting the date and time by the time counting circuit 46.

Figure 3:
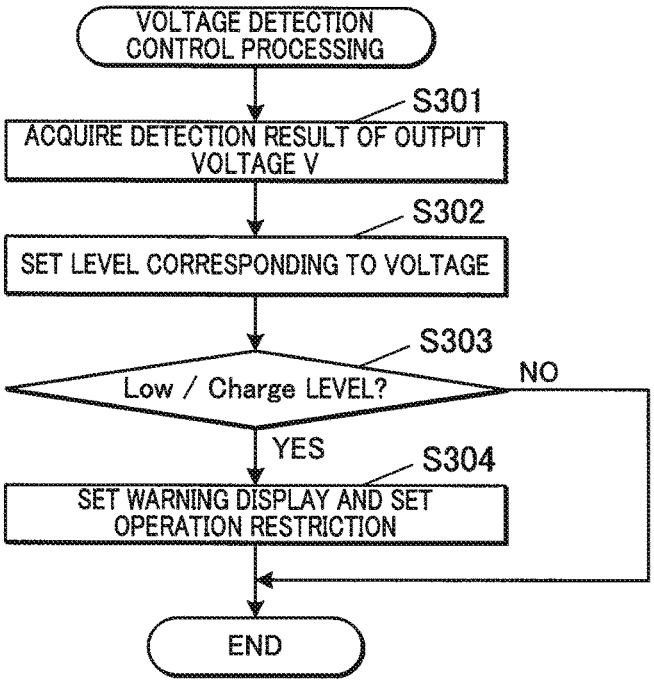
FIG. 3 is a flowchart showing a control procedure of voltage detection control processing.

FIG. 3 is a flowchart showing a control procedure by the host control section 41 of voltage detection control processing which is executed every minute in the electronic timepiece 1 in the embodiment.

This voltage detection control processing is periodically activated at a timing of predetermined seconds, for example, 0 second every minute except for the after-mentioned case.

When the voltage detection control processing starts, the host control section 41 (host CPU 411) acquires the detection result of the output voltage V of the battery 71 from the battery voltage detecting section 47 (step S301). The host control section 41 sets an output voltage level (High level, Mid level, Low level or Charge level) corresponding to the output voltage V (step S302).

The host control section 41 determines whether or not the output voltage level is the Low level or the Charge level (step S303). If it is determined that the output voltage level is not either of the Low level and the Charge level (step S303: NO), the host control section 41 ends the voltage detection control processing. If it is determined that the output voltage level is the Low level or the Charge level (step S303: YES), the host control section 41 performs the setting of operation restriction corresponding to the set output voltage level and the setting regarding warning display in a case of Low level (step S304; display stopping step, display stopping section). Then, the host control section 41 ends the voltage detection control processing.

Next, the operation for date and time correction and positioning in the electronic timepiece 1 in the embodiment will be described.

In the electronic timepiece 1, the host control section 41 operates the satellite radio wave reception processing section 50 and acquires accurate date and time information from the satellite radio wave reception processing section 50 automatically on a predetermined condition and according to a predetermined input operation of the user to the operation receiving section 61. The electronic timepiece 1 acquires information regarding the current position by causing the satellite radio wave reception processing section 50 to perform the positioning operation according to the predetermined input operation to the operation receiving section 61 by the user. The above information is used for correcting the date and time counted by the time counting circuit 46, and used for changing the setting of local time displayed by the display section 62.

The electronic timepiece 1 in the embodiment has an exception for a case of voltage decrease according to the operation of the satellite radio wave reception processing section 50. As mentioned above, there is a case where the output voltage temporarily decreases to the Charge level depending on the remaining amount of the battery 71 after the end of the operation of the satellite radio wave reception processing section 50 which was started in the Mid level. In this case, the time display operation and such like in the Charge level is not stopped for a predetermined exception period (pending period), for example, 60 minutes, from the end of the reception operation by the satellite radio wave reception processing section 50. Then, this case is treated as equivalent to the Low level, and there is performed a same operation restriction as the case of the Low level and a display operation (first notification operation) of warning regarding running out of the battery. Thus, during the exception period after the correction of the date and time of the time counting circuit 46 and the displayed date and time based on the acquired date and time, the display of the corrected date and time is continued.

Figure 4:
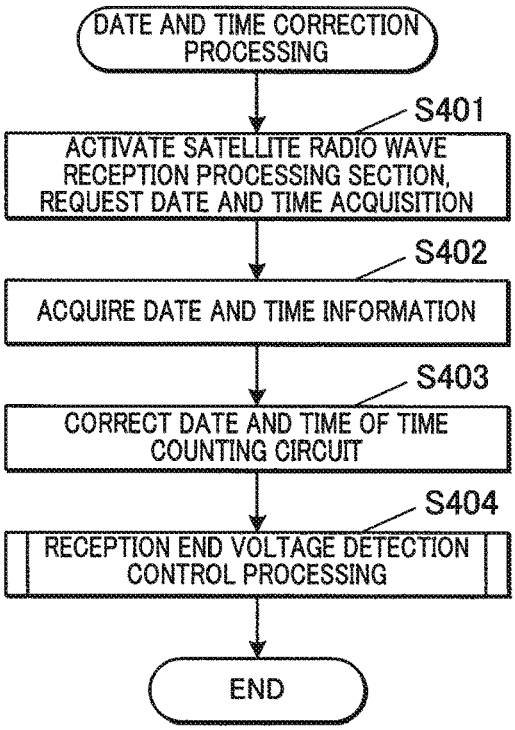
FIG. 4 is a flowchart showing a control procedure of date and time correction processing.

FIG. 4 is a flowchart showing a control procedure by the host control section 41 of the date and time correction processing executed by the electronic timepiece 1 in the embodiment.

The date and time correction processing is started when a predetermined condition is satisfied or according to a predetermined input operation to the operation receiving section 61 by the user as mentioned above.

When the date and time correction processing starts, the host control section 41 activates the satellite radio wave reception processing section 50 and requests acquisition of the date and time information (step S401). The host control section 41 waits for a signal input from the satellite radio wave reception processing section 50 and acquires date and time information (step S402). The host control section 41 corrects the date and time counted by the time counting circuit 46 on the basis of the acquired date and time information (step S403; correction reflecting step, correction reflecting section). The host control section 41 causes the display section 62 to display date and time based on the corrected date and time.

The host control section 41 invokes and executes the reception end voltage detection control processing (step S404), and ends the date and time correction processing when the reception end voltage detection control processing is finished.

Figure 5:
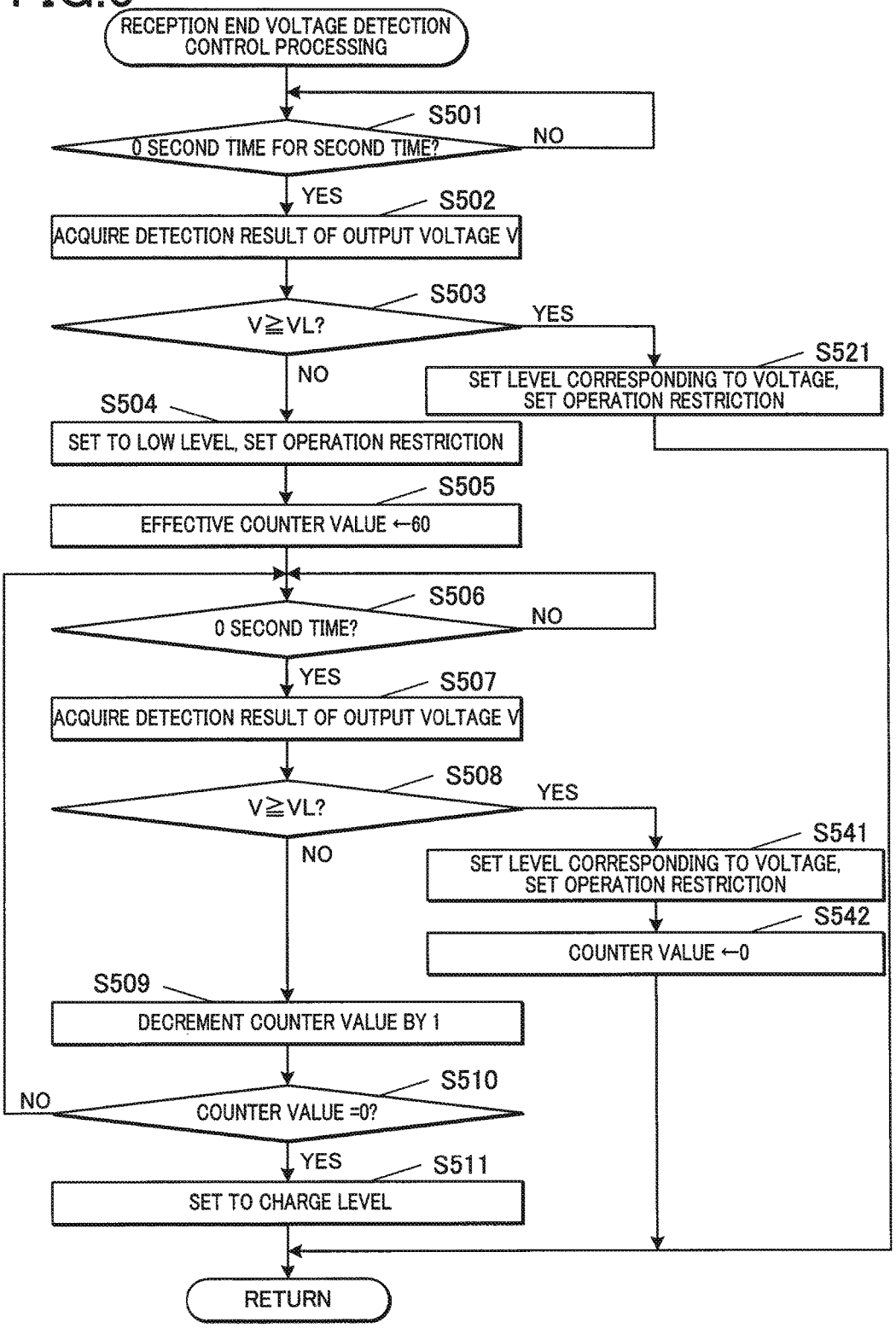
FIG. 5 is a flowchart showing a control procedure of reception end voltage detection control processing.

FIG. 5 is a flowchart showing a control procedure by the host control section 41 of the reception end voltage detection control processing which is invoked in the date and time correction processing.

The reception end voltage detection control processing is an embodiment of a display control method of the present invention. While this processing is invoked and executed, the voltage detection control processing shown in FIG. 3 is not executed.

When the reception end voltage detection control processing starts, the host control section 41 (host CPU 411) determines whether the 0 second timing of the second time after the start elapsed, the 0 second timing being the timing of 0 second every minute of the date and time counted by the time counting circuit 46 (step S501). If it is determined that the timing of the second 0 second timing has not elapsed (step S501: NO), the host control section 41 repeats the processing of step S501. That is, the host control section 41 stands by for approximately 1 to 2 minutes from the end of the operation of the satellite radio wave reception processing section 50, and slightly relieves the influence of the temporal voltage decrease following the operation of the satellite radio wave reception processing section 50.

If it is determined that the timing of the second 0 second timing elapsed (step S501: YES), the host control section 41 acquires the detection result of the output voltage V of the battery 71 from the battery voltage detecting section 47 (step S502). The host control section 41 determines whether or not the output voltage V is the first reference voltage VL or more (step S503). As described above, in a case where the voltage value itself is not acquired, that is, in a case where the step value of a predetermined number of steps is acquired or the like, the host control section 41 determines whether the step value is a value equivalent to the first reference voltage VL or more. If it is determined that the output voltage V or the step value is the first reference voltage VL or more (step S503: YES), the host control section 41 sets the output voltage level (High level, Mid level or Low level) corresponding to the output voltage V, and sets the operation restriction corresponding to the set output voltage level, if necessary (step S521). Then, the host control section 41 ends the reception end voltage detection control processing.

If it is not determined that the output voltage V is the first reference voltage VL or more (step S503: NO), the host control section 41 sets the output voltage level to the Low level, and sets the operation restriction corresponding to the Low level (step S504). The host control section 41 sets the value of the counter value 422 to "60" (step S505).

The host control section 41 determines whether the timing of 0 second timing elapsed (step S506). If it is not determined that the timing elapsed (step S506: NO), the host control section 41 repeats the processing of step S506.

If it is determined that the timing of 0 second timing elapsed (step S506: YES), the host control section 41 acquires the detection result of the output voltage V from the battery voltage detecting section 47 (step S507). The host control section 41 determines whether or not the output voltage V is the first reference voltage VL or more (step S508). If it is not determined that the output voltage VL is the first reference voltage VL or more (step S508: NO), the host control section 41 decrements the value of the counter value 422 by "1" (step S509). The host control section 41 determines whether the value of the count value data 422 is "0" (step S510). If it is not determined that the value of the counter value 422 is "0" (step S510: NO), the processing of the host control section 41 returns to step S506. If it is determined that the value of the counter value 422 is "0" (step S510: YES), the host control section 41 sets the output voltage level to the Charge level (step S511). Then, the host control section 41 ends the reception end voltage detection control processing.

In the determination processing of step S508, if it is determined that the output voltage V is the first reference voltage VL or more (step S508: YES), the host control section 41 sets the output voltage level (Low level or more) corresponding to the output voltage V, and sets the operation restriction corresponding to the set output voltage level if necessary (step S541). The host control section 41 sets the value of the counter value 422 to "0" (step S542), and ends the reception end voltage detection control processing.

The stop pending step (stop pending section) in the display control method (program) in the embodiment is configured by including the processing of steps S503, S504 and S505 among the above steps.

As described above, the electronic timepiece 1 in the embodiment includes a time counting circuit 46 which counts a date and time, a display section 62 which performs display of a time based on the counted date and time, a host control section 41, a satellite radio wave reception processing section 50 which performs a predetermined processing operation of acquiring date and time information, and a power supply section 70 which supplies power to the sections from the battery 71. When the output voltage V from the power supply section 70 decreases to less than the first reference voltage VL, the host control section 41 stops the display operation by the display section 62. When the date and time information is acquired by the operation of the satellite radio wave reception processing section 50, the host control section 41 corrects the date and time counted by the time counting circuit 46 on the basis of the acquired date and time information, and causes the display section 62 to display the corrected time. When the output voltage V decreases to less than the first reference voltage VL following the acquisition operation of the date and time information by the satellite radio wave reception processing section 50, the host control section 41 does not stop the time display operation for a predetermined exception period (60 minutes).

In such a way, even when the output voltage V from the power supply section 70 decreases to less than the first reference voltage VL which is normally set to be a little high as the voltage for stopping the display operation with slight flexibility in order to surely prevent data loss and such like, the time display is continued during the exception period in a case where the decrease is a temporal decrease following the acquisition operation of the date and time information by the satellite radio wave reception processing section 50. Thus, in the electronic timepiece 1, it is possible to effectively prevent the situation that the operation is stopped without sufficiently displaying the corrected date and time and the user cannot be aware of the corrected date and time. Even in the electronic timepiece 1 in which the decrease in the output voltage V is remarkably generated easily when a high-load operation is performed in a case of, for example, the battery 71 having a small capacity, it is possible to appropriately perform both of the correction operation of the date and time and the display operation of the corrected date and time within a range not generating a problem. Accordingly, in this electronic timepiece 1, the user can be aware of accurate time information more surely.

In a case where the output voltage V decreases to less than the first reference voltage VL following the acquisition operation of the date and time information by the satellite radio wave reception processing section 50, the host control section 41 causes the display section 62 to perform the notification operation indicating the Low level, such as a hand movement of the second hand every two seconds. Thus, it is possible to make the user aware that the remaining amount of the battery 71 is small and indicate the difficulty of further execution of the high-load operation, and urge the user to perform power generation or charge in a case where a secondary cell is used. Especially, since the operation of the second hand which performs time display is also used for the notification operation, it is possible to appropriately make the user aware of the lack of battery remaining amount while preventing the unnecessary increase in power consumption.

The host control section 41 causes the display section 62 to perform a notification operation in a case where the output voltage V is less than the second reference voltage VM which is higher than the first reference voltage VL. In such a way, since the user is aware of the lack of battery remaining amount when the battery amount is large by one level in a normal state (when the output voltage V is high), the user can exchange dry cells and perform power generation and charge well in advance. Thus, it is possible to allow execution of the acquisition operation of the date and time information stably and maintain the display of accurate date and time.

The notification operation in a case where the output voltage is less than the first reference voltage VL after the operation of the satellite radio wave reception processing section 50 is same as the notification operation in a case where the output voltage is less than the second reference voltage VM in a normal time. Thus, the user can be easily aware of the content indicated by the display. By the shared use of a simple notification pattern, it is possible to simplify the processing for the control operation and the drive operation.

In a case where the output voltage V becomes the first reference voltage VL or more in the exception period, the host control section 41 continues the time display operation. In a case where the output voltage V does not become the first reference voltage VL or more in the exception period, the host control section 41 stops the time display operation. That is, when the output voltage V returns to the normal state within the exception period, the device may return to the normal state without change. When the output voltage V does not return to the normal state, the host control section 41 waits for the elapse of the exception period, and then switches to the Charge level to stop the display operation. Thus, it is possible to achieve suppress of the discharge and safety of data and such like before the discharge of the battery 71 proceeds excessively.

The second processor has a satellite radio wave reception processing section 50 which performs the processing operation for reception of radio waves from the positioning satellites. In such a way, the present invention is applied to display control after the date and time acquisition operation by the satellite radio wave reception processing section 50 which has a remarkably large power consumption for one operation while easily acquiring the date and time information in various areas of the world. Thus, it is possible to perform both of the acquisition operation of accurate date and time and the display operation of the accurate date and time more effectively and easily indicate the accurate date and time to the user.

The electronic timepiece further includes a battery voltage detecting section 47 which determines whether or not the output voltage V is the first reference voltage VL or more, and the host control section 41 determines whether to stop the time display operation on the basis of the determination result of the battery voltage detecting section 47. In such a way, the level of the output voltage V of the battery 71 is determined by using a dedicated circuit and the host control section 41 performs only the operation control. Thus, it is possible to easily perform battery control appropriately.

The display section 62 has a plurality of hands which displays a time, and the host control section 41 continues the operation of at least hands which display the hour and the minute among the plurality of hands in the exception period.

Thus, in the electronic timepiece using hands, it is possible to operate at least the hands necessary for indicating the accurate time while suppressing the power consumption effectively when the output voltage is in the Charge level in a normal case.

The display control method in the embodiment includes a display stopping step (step S304) of stopping the display operation by the display section 62 when the output voltage V from the power supply section 70 decreases to less than the first reference voltage VL, a correction reflecting step (step S403) of correcting a date and time counted by the time counting circuit 46 on the basis of the acquired date and time information and causing the display section 62 to display the corrected time when the date and time information is acquired by the operation of the satellite radio wave reception processing section 50, and a stop pending step (steps S503 to S505) of not stopping the time display operation during a predetermined exception period when the output voltage V decreases to less than the first reference voltage VL following the acquisition operation of the date and time information by the satellite radio wave reception processing section 50.

In such a way, the exception period for sufficiently displaying the corrected date and time is set after the operation of the satellite radio wave reception processing section 50 which has a remarkably large power consumption for one date and time acquisition operation. Thus, it is possible to effectively indicate the correct date and time to the user. Even in the electronic timepiece 1 which remarkably easily generates the decrease in the output voltage V when a high-load operation is performed, for example, in a case where the battery 71 has a small capacity, it is possible to appropriately perform both of the correction operation of the date and time and the display operation of the corrected date and time within a rage not generating a problem. Accordingly, it is possible to make the user aware of the accurate time information more surely by this display control method.

The program 641 in the embodiment causes the computer (host control section 41) in the electronic timepiece 1 to function as a display stopping section (step S304) stopping the display operation by the display section 62 when the output voltage V from the power supply section 70 decreases to less than the first reference voltage VL, a correction reflecting section (step S403) correcting a date and time counted by the time counting circuit 46 on the basis of the acquired date and time information and causing the display section 62 to display the corrected time when the date and time information is acquired by the operation of the satellite radio wave reception processing section 50, and a stop pending section (steps S503 to S505) not stopping the time display operation during a predetermined exception period when the output voltage V decreases to less than the first reference voltage VL following the acquisition operation of the date and time information by the satellite radio wave reception processing section 50.

By installing such a program 641 and causing the host control section 41 to execute the above processing, in the electronic timepiece 1, it is possible to indicate the accurate time information to the user more surely in an easy and simple manner.

The present invention is not limited to the above embodiment, and various changes can be made.

For example, the embodiment has been described for the reception operation of the date and time by the satellite radio wave reception processing section 50. However, the present invention can also be applied to a case of receiving other broadcast radio waves including time information, for example, standard radio waves in a low frequency band and such like.

When the satellite radio wave reception processing section 50 is activated to acquire the date and time information, the positioning operation does not need to be performed together, and only the date and time information may be acquired to end the processing. Even in this case, when the output voltage V decreases to less than the first reference voltage VL, the same operation control can be performed.

In the embodiment, the output voltage is detected at the timing of 0 second timing. However, the detection may be a real time measurement, or the detection interval may be a little larger than one minute. In the embodiment, the detection of voltage decrease following the operation of the satellite radio wave reception processing section 50 is performed by using the output voltage at the timing of the second 0 second timing from the end of the operation of the satellite radio wave reception processing section 50. However, the timing may be the timing of the first 0 second timing. Or, only in this case, the output voltage may be detected a predetermined time, for example, two minutes after the end of the operation, not matching the timing of the 0 second timing.

In the embodiment, in a case where the output voltage is in the Charge level when the operation of the satellite radio wave reception processing section 50 is finished, the level is set as the Low level for up to 60 minutes so as not to stop the display operation. However, the period may not be 60 minutes. Also for the time acquisition operation by a section other than the satellite radio wave reception processing section 50, when a same control is performed, the time for not stopping the display operation may be set or changed for each operation according to the type of the operation.

In the embodiment, a same notification operation (two seconds hand movement) is performed for the normal Low level and the Low level following the time acquisition operation. However, the contents of the notification operations for the Low levels may be different from each other. That is, in a case where the output voltage comes into the Charge level following the time acquisition operation, the level may be set to a level different from the Low level as long as the stop of the time display operation can be suspended temporarily. In a case where there is another hand other than the hour hand, the minute hand and the second hand, the notification operation may be performed by the another hand. Though it is preferable to perform such a notification operation, the notification operation does not necessarily need to be performed.

The embodiment has been described by taking, as an example, a case of performing display by using a plurality of hands. However, the electronic timepiece may be an electronic timepiece which includes a digital display screen. In this case, a sign or the like indicating the Low level may be displayed, or the warning of the lack of battery remaining amount may be displayed by stopping the display of a date and the display for other functions. The warning operation can be made by operating the notification operation 63. However, in this case, it may be set to perform the operation for only a short time such as immediate after the setting of the Low level, for example, in order to suppress the increase in the power consumption due to the warning operation.

The 60 minutes as an exception period (pending period) described in the embodiment is an example. The exception period may be another time as long as the voltage necessary for the display operation of the display section 62 and the microcomputer 40 can be maintained and a time for enabling the user to be aware of the corrected accurate time is secured.

The above description has been made by taking, as an example, various non-volatile memories such as a flash memory and the ROM 64 including the mask ROM as a computer readable medium storing a program 641 for the voltage monitoring control by the host control section 41 according to the present invention. However, the present invention is not limited to this. As other computer readable media, an HDD (Hard Disk Drive), a portable storage medium such as a CD-ROM and a DVD disk can be applied. Also, as a medium providing program data according to the present invention via a communication line, carrier wave can also be applied to the present invention.

The other specific details such as configurations, control contents and procedures shown in the embodiments can be appropriately changed within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2017-034397 filed on Feb. 27, 2017 including description, claims, drawings, and abstract are incorporated herein by reference in its entirety.

What is claimed is:

1. An electronic timepiece, comprising:

a counter which counts a time;

a display section which performs time display based on the counted time;

a first processor;

a second processor which performs a predetermined processing operation of acquiring time information; and a power supply section which supplies electric power to each section from a battery, wherein when an output voltage from the power supply section decreases to less than a predetermined first reference voltage, the first processor stops a display operation by the display section, when the time information is acquired by the processing operation of the second processor, the first processor corrects the time counted by the counter based on the acquired time information and causes the display section to display the corrected time, and when the output voltage decreases to less than the first reference voltage following an acquisition operation of the time information by the second processor, the first processor does not stop a time display operation during a predetermined pending period.

2. The electronic timepiece according to claim 1, wherein, when the output voltage decreases to less than the first reference voltage following the acquisition operation of the time information by the second processor, the first processor causes the display section to perform a first notification operation.

3. The electronic timepiece according to claim 2, wherein, when the output voltage is less than a second reference voltage which is higher than the first reference voltage, the first processor causes the display section to perform a second notification operation.

4. The electronic timepiece according to claim 3, wherein the first notification operation is a same operation as the second notification operation.

5. The electronic timepiece according to claim 1, wherein the first processor continues the time display operation when the output voltage becomes the first reference voltage or more in the pending period, and the first processor stops the time display operation when the output voltage does not become the first reference voltage or more in the pending period.

6. The electronic timepiece according to claim 2, wherein the first processor continues the time display operation when the output voltage becomes the first reference voltage or more in the pending period, and the first processor stops the time display operation when the output voltage does not become the first reference voltage or more in the pending period.

7. The electronic timepiece according to claim 3, wherein the first processor continues the time display operation when the output voltage becomes the first reference voltage or more in the pending period, and the first processor stops the time display operation when the output voltage does not become the first reference voltage or more in the pending period.

8. The electronic timepiece according to claim 4, wherein the first processor continues the time display operation when the output voltage becomes the first reference voltage or more in the pending period, and the first processor stops the time display operation when the output voltage does not become the first reference voltage or more in the pending period.

9. The electronic timepiece according to claim 1, wherein the second processor has a satellite radio wave receiving section which performs a processing operation for receiving radio waves from a positioning satellite.

10. The electronic timepiece according to claim 2, wherein the second processor has a satellite radio wave receiving section which performs a processing operation for receiving radio waves from a positioning satellite.

11. The electronic timepiece according to claim 3, wherein the second processor has a satellite radio wave receiving section which performs a processing operation for receiving radio waves from a positioning satellite.

12. The electronic timepiece according to claim 4, wherein the second processor has a satellite radio wave receiving section which performs a processing operation for receiving radio waves from a positioning satellite.

13. The electronic timepiece according to claim 5, wherein the second processor has a satellite radio wave receiving section which performs a processing operation for receiving radio waves from a positioning satellite.

14. The electronic timepiece according to claim 6, wherein the second processor has a satellite radio wave receiving section which performs a processing operation for receiving radio waves from a positioning satellite.

15. The electronic timepiece according to claim 7, wherein the second processor has a satellite radio wave receiving section which performs a processing operation for receiving radio waves from a positioning satellite.

16. The electronic timepiece according to claim 8, wherein the second processor has a satellite radio wave receiving section which performs a processing operation for receiving radio waves from a positioning satellite.

17. The electronic timepiece according to claim 1, further comprising a voltage detecting section which determines whether or not the output voltage is the first reference voltage or more, wherein the first processor determines whether to stop the time display operation based on a determination result of the voltage detecting section.

18. The electronic timepiece according to claim 1, wherein the display section has a plurality of hands which displays a time, and the first processor continues an operation of at least a hand which displays an hour and a minute among the plurality of hands in the pending period.

19. A display control method of an electronic timepiece that includes: a counter which counts a time; a display section which performs time display based on the counted time; a second processor which performs a predetermined processing operation of acquiring time information; and a power supply section which supplies electric power to each section from a battery, the method comprising:

a display stopping step of stopping a display operation by the display section when an output voltage from the power supply section decreases to less than a predetermined first reference voltage;

a correction reflecting step of correcting the time counted by the counter based on the acquired time information and causing the display section to display the corrected time when the time information is acquired by the processing operation of the second processor; and a stop pending step of not stopping a time display operation during a predetermined pending period when the output voltage decreases to less than the first reference voltage following an acquisition operation of the time information by the second processor.

20. A non-transitory storage medium storing a program which is readable by a computer of an electronic timepiece that includes: a counter which counts a time; a display section which performs time display based on the counted time; a second processor which performs a predetermined processing operation of acquiring time information; and a power supply section which supplies electric power to each section from a battery, the program causing the computer to function as:

a display stopping section which stops a display operation by the display section when an output voltage from the power supply section decreases to less than a predetermined first reference voltage;

a correction reflecting section which corrects the time counted by the counter based on the acquired time information and causes the display section to display the corrected time when the time information is acquired by the processing operation of the second processor; and a stop pending section which does not stop a time display operation during a predetermined pending period when the output voltage decreases to less than the first reference voltage following an acquisition operation of the time information by the second processor.

* * * * *